US006814227B2

(12) United States Patent
Seligman et al.

(10) Patent No.: US 6,814,227 B2
(45) Date of Patent: Nov. 9, 2004

(54) COIN HOLDER AND DISPLAY DEVICE

(75) Inventors: Tom Seligman, 10256 NW. 47th St., #B, Sunrise, FL (US) 33351; Janette Seligman, Sunrise, FL (US)

(73) Assignee: Tom Seligman, Sunrise, FL (US)

( * ) Notice: Subject to any disclaimer, the term of this patent is extended or adjusted under 35 U.S.C. 154(b) by 8 days.

(21) Appl. No.: 10/103,559

(22) Filed: Mar. 21, 2002

(65) Prior Publication Data

US 2002/0162756 A1 Nov. 7, 2002

Related U.S. Application Data

(60) Provisional application No. 60/277,771, filed on Mar. 21, 2001.

(51) Int. Cl.[7] ..... A45C 1/00

(52) U.S. Cl. ..... 206/82; 206/8; 206/459.5; 206/776

(58) Field of Search ..... 206/0.8, 0.81–0.84, 206/775, 776, 459.5

(56) References Cited

U.S. PATENT DOCUMENTS 2,428,498 A * 10/1947 McWilliams ..... 206/83
3,751,128 A * 8/1973 Skinner et al. ..... 312/114
3,782,537 A * 1/1974 Segel ..... 206/82
3,797,649 A * 3/1974 Ringle ..... 206/82
4,878,579 A * 11/1989 Hager ..... 206/84
5,011,005 A 4/1991 Boyd et al.
5,042,650 A * 8/1991 Mayer et al. ..... 206/84
5,069,347 A 12/1991 Newman
5,768,915 A 6/1998 Crumrine et al.
5,988,366 A 11/1999 Krull et al.

* cited by examiner

*Primary Examiner*—Jim Foster
(74) *Attorney, Agent, or Firm*—Mark D. Bowen, Esq.; Stearns Weaver Miller Weissler Alhadeff & Sitterson, P.A.

(57) ABSTRACT

A freestanding coin holder capable of displaying a coin such that all sides, namely the front, back, and circumferential edge are viewable. First and second panel members are connected in opposing face-to-face relation such that a coin may be received in a generally cylindrical and laterally projecting coin-receiving chamber defined by optically transparent portions so that the front and back of the coin (e.g. heads side and tails side) as well as the circumferential edge of the coin are clearly visible. A base functions as a stand thereby allowing the coin holder to be disposed in a vertically free-standing manner.

4 Claims, 6 Drawing Sheets

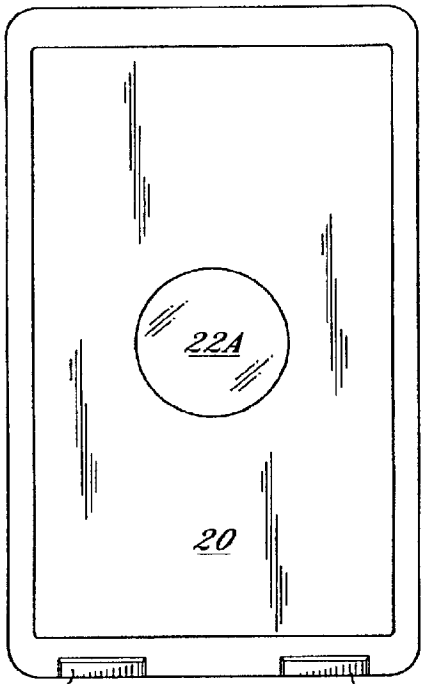
Fig. 11
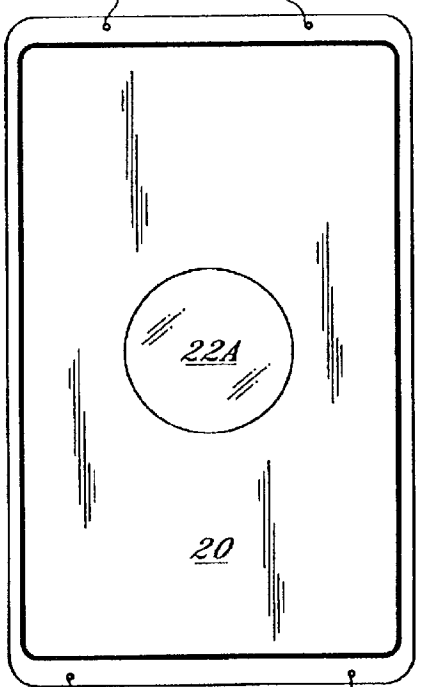
Fig. 12
Fig. 10
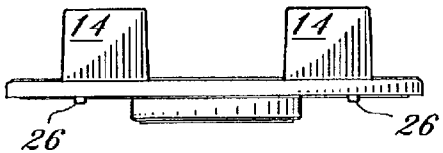
Fig. 13

COIN HOLDER AND DISPLAY DEVICE

CROSS-REFERENCE TO RELATED APPLICATIONS

This application claims the benefit of U.S. Provisional Patent Application Ser. No. 60/277,771, filed Mar. 21, 2001.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

The present invention relates to coin holders for collectable coins, and in particular, to coin holders having optically transparent portions adapted to display coins such that the opposing sides of the coin as well as the circumferential edge may be viewed and inspected.

2. Description of Related Art

Coin collecting is a popular hobby. Those involved with numismatics, including collectors and dealers, require safe storage and attractive display for their coins. The prior art reveals a number of coin storage and display devices. Among those devices are relatively simple books containing cardboard sheets which incorporate circular openings defining coin receiving depressions wherein coins may be insertably disposed for display. In addition, a variety of rigid plastic holders are available. Typical of these plastic holder devices are holders wherein one or more coins are sandwiched between opposing clear plastic layers. The opposing plastic layers may be connected by fasteners, snap-fit, adhesive or plastic welding techniques.

There are a number of disadvantages present with plastic coin holders known in the background art. One significant disadvantage is that such conventional coin holders are limited in that they provide for visual inspection of the front and back of the coin, but generally do not provide for any visual inspection of the edge portion of the coin. Since the quality of the edge portion of the coin effects value there exists a need for a coin holder that provides for a full 360 degree visual inspection of the edge of the coin in addition to the front and back sides. Another disadvantage present with conventional coin holders of the background art is that such holders are not adequately adapted to permit the holder(s) to be displayed in a vertically freestanding manner. Accordingly, there further exists a need for a freestanding coin holder that is capable of being displayed in a vertically upright, self-supporting manner.

BRIEF SUMMARY OF THE INVENTION

The present invention overcomes the disadvantages present in the background art by providing an improved freestanding coin holder capable of displaying a coin such that all sides, namely the front, back, and circumferential edge are viewable. The coin holder of the present invention is comprised of first and second panel members connected in opposing face-to-face relation such that a coin may be received in a generally cylindrical coin-receiving chamber defined between the panel members. As with conventional coin holders the front and back of the coin (e.g. heads side and tails side) are clearly visible. In addition, the coin-receiving chamber projects from one side of the assembly such that the circumferential edge of the coin is clearly visible and subject to inspection. The first and second panel members are preferably fastened by a suitable fastening method, such as sonic heat welding and/or through the use of mechanical fasteners or adhesives. The coin holder further includes a base that functions as a stand thereby allowing the coin holder to be disposed in a vertically free-standing manner. In a preferred embodiment, each panel member forming the coin holder includes at least one foot projecting proximal the bottom edge thereof and generally perpendicular to the external surface thereof. The projecting feet permit the assembly to be disposed in a generally vertical freestanding manner such that the holder may be positioned for display.

Accordingly, it is an object of the present invention to provide an improved coin holder and display.

Yet another object of the present invention is to provide a coin holder and display wherein the edge portion of the coin is clearly visible.

Still another object of the present invention is to provide an improved coin holder and display that is structurally adapted with a base that permits the device to be freestanding.

In accordance with these and other objects which will become apparent hereinafter, the instant invention will now be described with particular reference to the accompanying drawings.

BRIEF DESCRIPTION OF THE SEVERAL VIEWS OF THE DRAWINGS

FIG. 10 is a rear elevational view of a second panel member;

FIG. 11 is a side sectional view thereof;

FIG. 12 is a front view thereof;

FIG. 13 is a bottom view thereof;

DETAILED DESCRIPTION OF THE INVENTION

Figure 2:
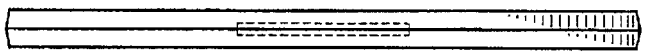
Fig. 2 Prior Art
FIG. 2 is a side view thereof.
Figure 1:
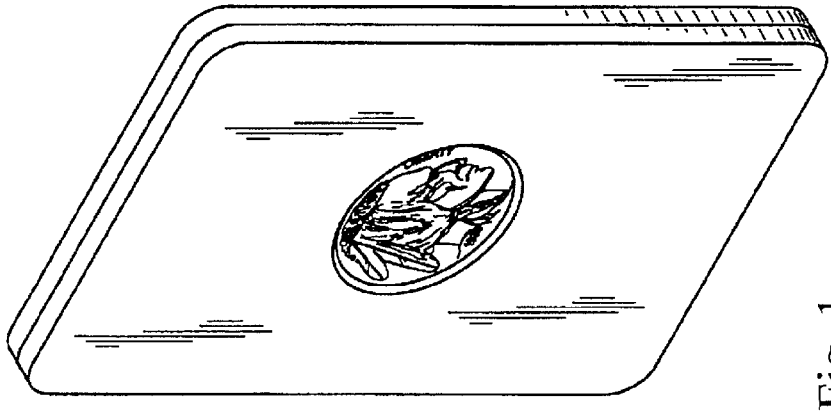
Fig. 1 Prior Art
FIG. 1 is a perspective view of a coin holder disclosed in the prior art.

With reference now to the drawings, FIGS. 1 and 2 depict a coin holder in accordance with the prior art. The prior coin holder receives a coin such that only the opposing sides of the coin, and not the edge, are visible. In addition, the prior art coin holder is formed of two panels that are connected in face-to-face relation thereby forming an uneven projecting seam therebetween. The seam prevents the prior art coin holder from standing on end, thus preventing the prior art coin holder from being used as a free standing display.

Figure 3:
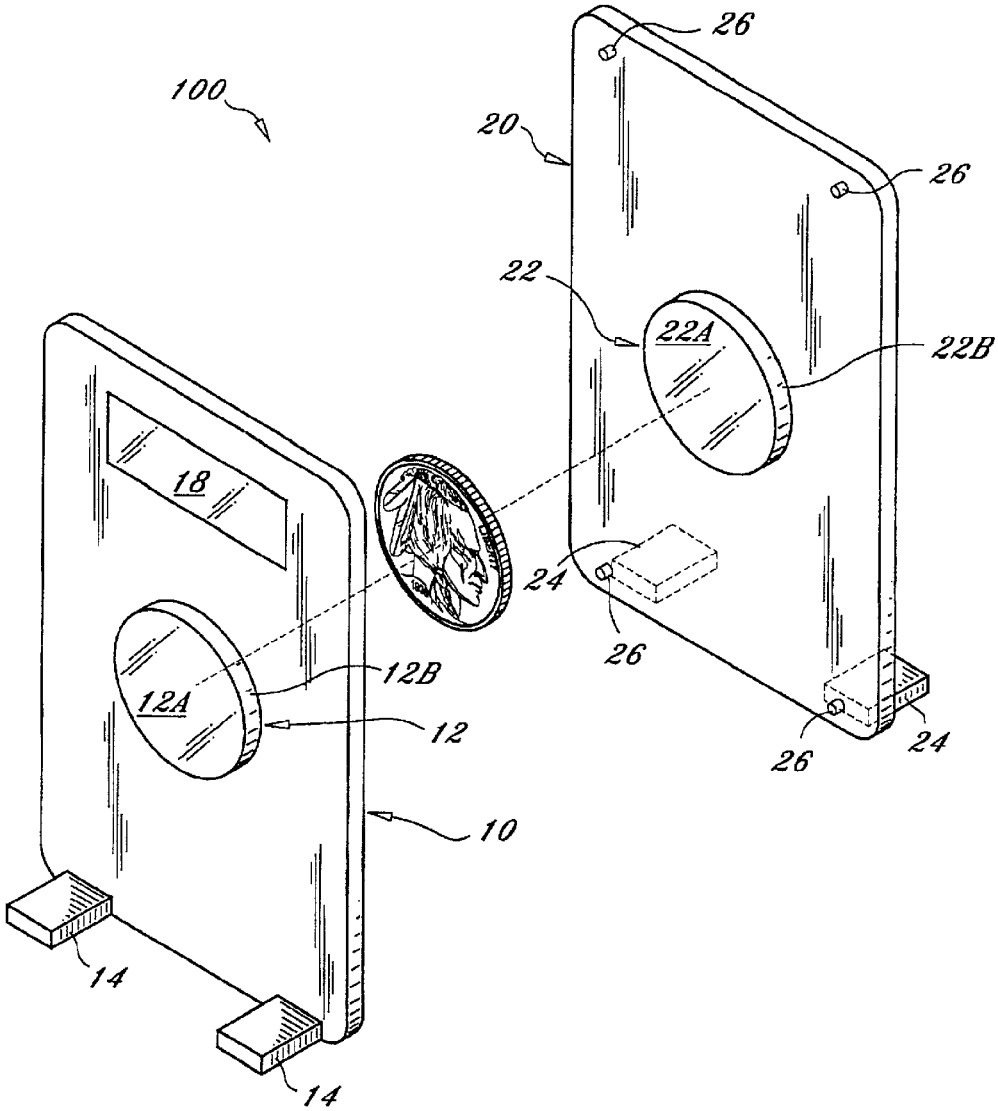
FIG. 3 is a front exploded perspective view of a coin holder according to a preferred embodiment of the present invention.
Figures 4, 5:
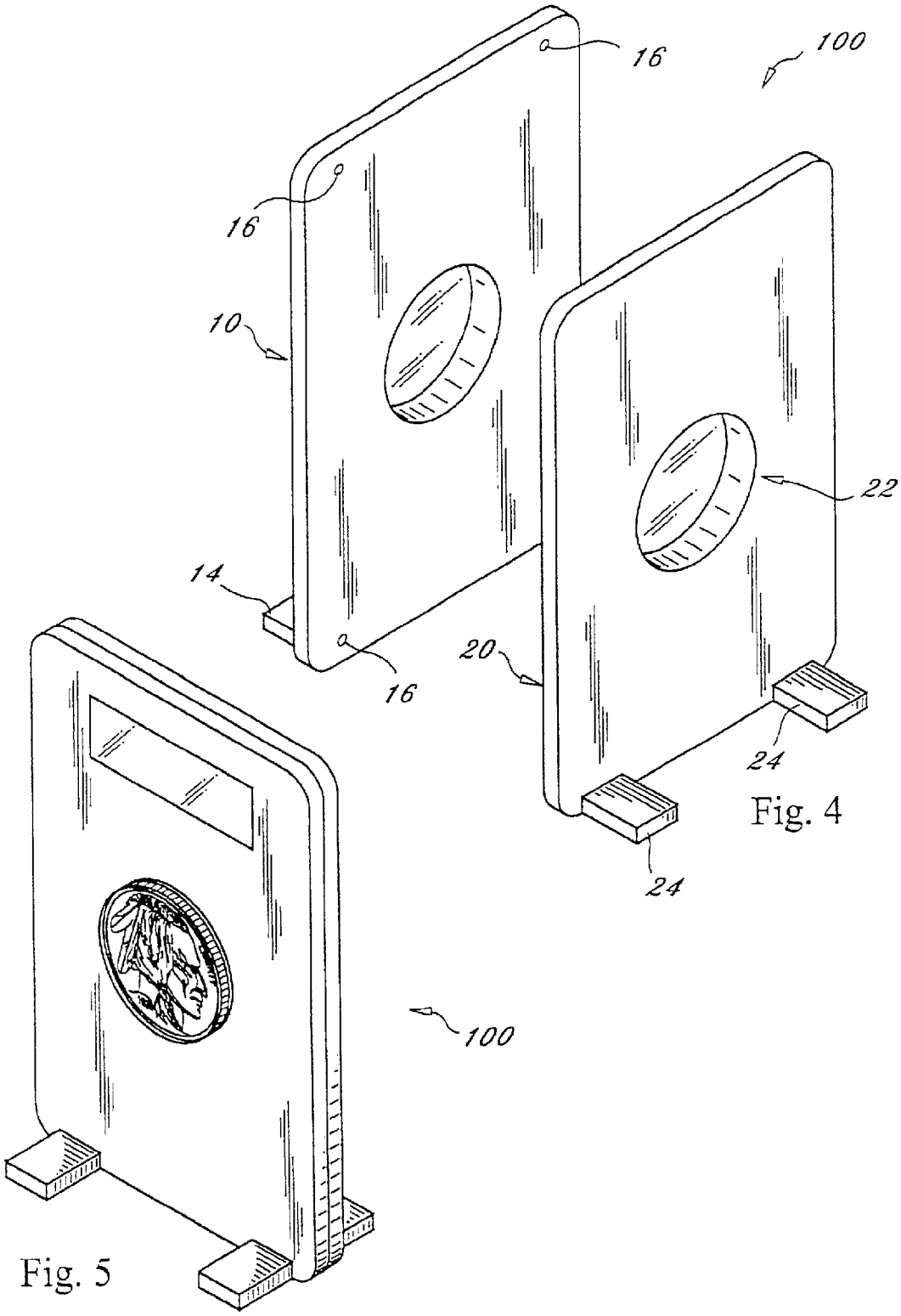
FIG. 4 is rear exploded perspective view thereof.
FIG. 5 is a front perspective view of an assembled coin holder according to the present invention.
Figure 8:
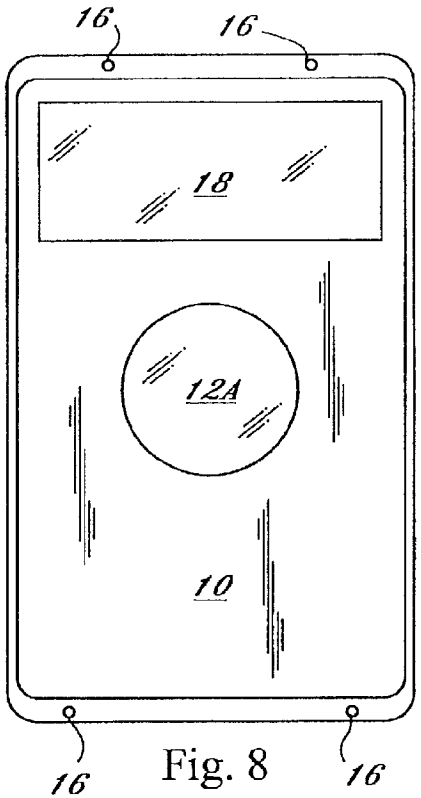
FIG. 8 is a rear elevational view thereof.
Figure 7:
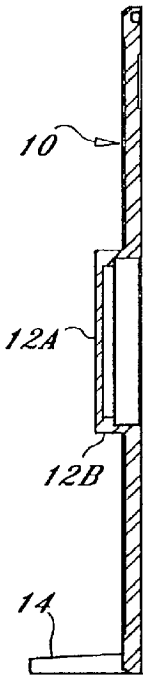
FIG. 7 is a side sectional view thereof.
Figure 6:
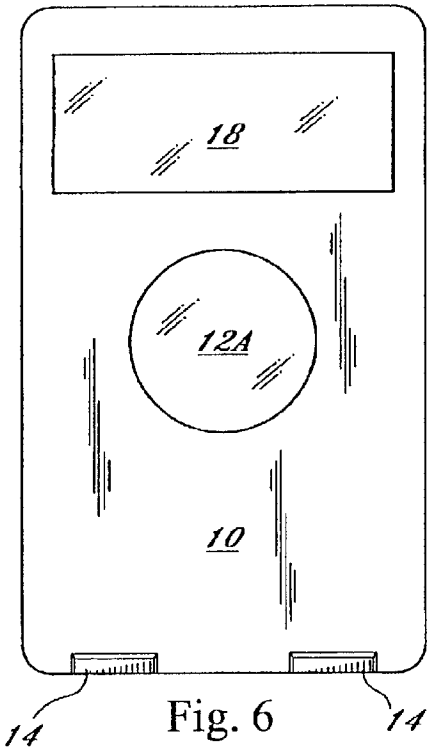
FIG. 6 is a front elevational view of a first panel member.
Figure 9:
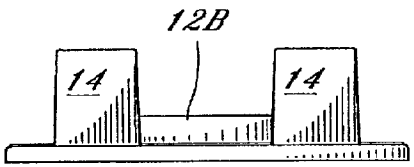
FIG. 9 is a bottom view thereof.

FIGS. 3 through 15 depict a preferred embodiment coin holder and display device according to the present invention. The coin holder and display, generally referenced as 100, provides an improved freestanding coin holder and display device capable of displaying a coin such that all sides, namely front, back, and edge, are viewable. The coin holder and display device 100 includes a first panel 10 and a second panel 20. Panels 10 and 20 are preferably formed from a rigid and at least partially transparent plastic-type material, however, any suitable material is considered within the scope of the present invention. Panels 10 and 20 are adapted for mating face-to-face engagement as best seen in FIGS. 3–5. First and second panel members 10 and 20 are preferably fastened by a suitable fastening method, such as sonic welding, heat welding, and/or through the use of mechanical fasteners or adhesives. As best depicted in FIG. 2A panel 10 defines a pair of cavities 16 on the top and bottom edges thereof, which cavities receive pins 26 projecting from panel 20 to facilitate aligned mating of panels 10 and 20 as shown in FIG. 5.

Figure 14:
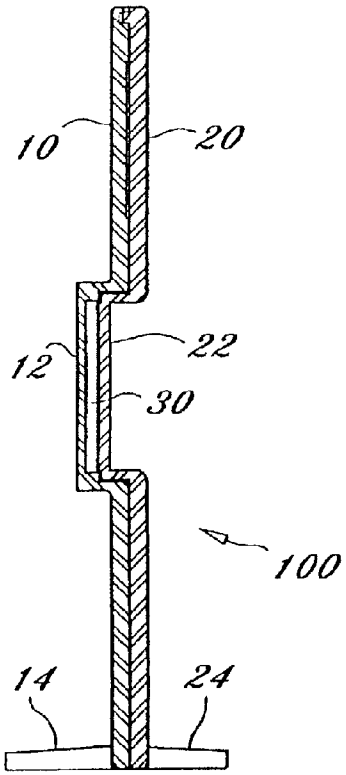
FIG. 14 is a side sectional view of an assembled coin holder according to the present invention without a coin.

A significant aspect of the invention relates to the structure of the panels, and particularly to a projecting coin holding structure that allows for visual inspection of edge of the coin, in addition to the front and rear sides. FIGS. 6–9 depict detailed views of panel 10, and FIGS. 10–13 depict detailed views of panel 20. More particularly, panels 10 and 20 each include a generally cylindrical projecting portion, referenced as 12 and 22 respectively. Projecting portions 12 and 22 each include a face, referenced as 12A and 22A respectively, and a circumferential wall or rim, referenced as 12B and 22B. Projecting portions 12 and 22 are correspondingly sized and shaped so as to define an internal, generally cylindrical, coin-receiving chamber 30 when panels 10 and 20 are matingly joined as best depicted in FIG. 14. Coin-receiving chamber 30 is preferably sized and shaped for a particular coin (e.g. Quarter, Dime, Nickel etc.), however, the chamber may be any suitable shape for receiving coins. The projecting portions, and particularly faces 12A and 22A, and at least the circumferential rim 12B are defined by optically transparent material so as to allow for the visual inspection of a coin received therein.

As with conventional coin holders and displays the coin-receiving chamber provides for secure storage and display of a coin disposed therein to allow for the visual inspection of the front and back sides of the coin (e.g. heads and tails) as well as the circumferential edge of the coin. Accordingly, faces 12A and 22A are preferably polished to an optically superior grade so as to provide a clear undistorted view of front and back sides of the coin. In addition, a significant aspect of the present invention relates to the projecting structure of the coin-receiving chamber to allow for the visual inspection of the edge of the coin. As best depicted in FIG. 5, the coin-receiving chamber projects sufficiently such that the edge of a coin received therein is spaced from the planar surface of panel member 10 so as to be viewable. The projecting coin-receiving chamber further allows for visual inspection of the edge of the coin through circumferential rim 12B. Accordingly, rim 12B is preferably optically polished so as to provide a clear and undistorted view of the edge of the coin. In addition, panel 10 preferably further includes an optically polished portion, referenced as 18, to allow for a clear and undistorted view of written information regarding the encased coin. Such information may include certification and/or authentification documents.

As noted above, the present invention is adapted for free standing display. More particularly, each panel member 10 and 20 preferably includes a pair of integrally molded feet, referenced as 14 and 24 respectively, projecting proximal the bottom edge thereof and generally perpendicular to the external surface thereof as best seen in FIGS. 3–5. Feet 14 and 24, combine to permit the assembly to be disposed in a generally vertical freestanding manner for display purposes. Since the coin-receiving chamber projects outward, the center of mass of the device is correspondingly shifted in the same direction. Thus, feet 14 may be longer than feet 24 to prevent the weight of the projecting coin from causing the display to tip, or conversely feet 24 do not need to be as long as feet 14.

Figure 17B:
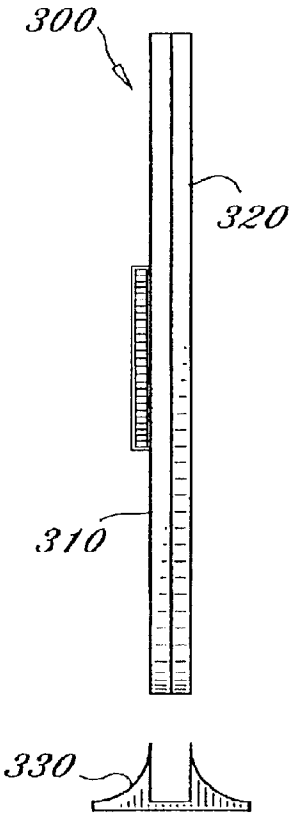
FIG. 17B is an exploded view thereof.
Figure 17A:
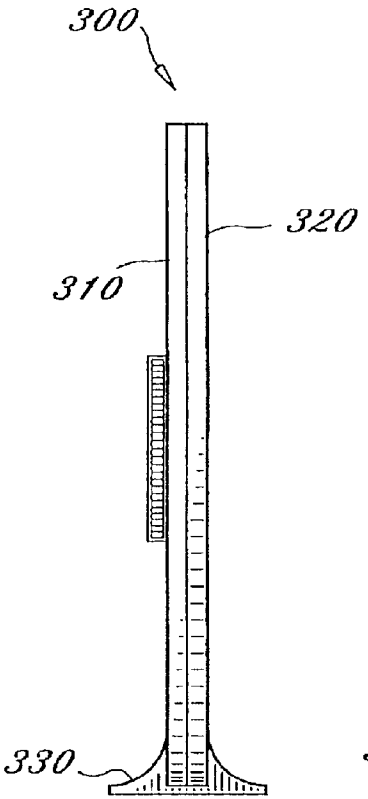
FIG. 17A is a side view of another alternate embodiment coin holder according to the present invention having a detachable base.
Figure 16:
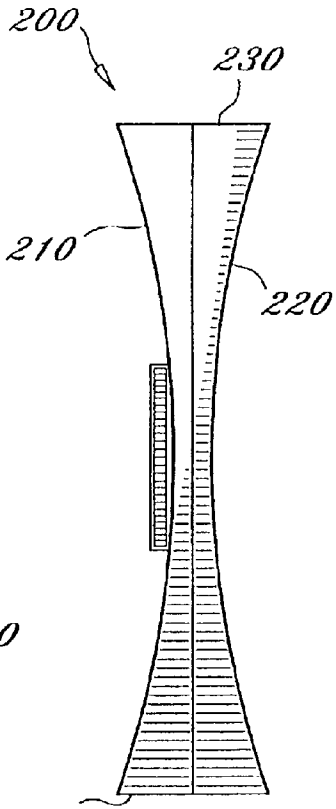
FIG. 16 is a side view of an alternate embodiment coin holder according to the present invention.
Figure 15:
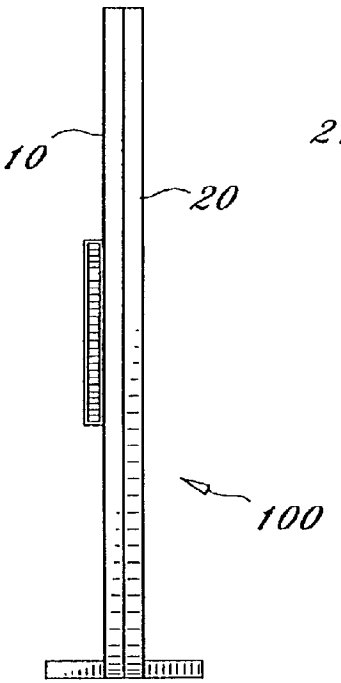
FIG. 15 is a side view thereof with a coin.

FIG. 16 depicts and alternate coin holder and display structure, generally referenced as 200. The alternate embodiment coin holder differs from the preferred embodiment in that panels 210 and 220 have concave outer surfaces such that the top and bottom portions thereof each flare outward to form wide ends, referenced as 230 and 240, each of which will function as a base that will support the coin holder in a vertically free standing configuration. FIGS. 17A and 17B depict yet another alternate embodiment coin holder, generally referenced as 300, formed of first and second panel members, 310 and 320. Coin holder 300 includes a detachable base 330 that functions as a stand that supports coin holder 300 in a vertically free-standing manner. Stand 330 comprises a base defining a notch for receiving a coin holder therein such that the coin holder may be displayed in a vertical orientation as seen in FIG. 17A.

The instant invention has been shown and described herein in what is considered to be the most practical and preferred embodiment. It is recognized, however, that departures may be made therefrom within the scope of the invention and that obvious modifications will occur to a person skilled in the art.

What we claim is:

1. A coin holder and display device for the storage and display of collectable coins, said device comprising:

a display structure having opposing first and second side surfaces;

said first side surface defining a generally cylindrical projecting portion, said cylindrical projecting portion including a first generally circular planar wall and a circumferential wall;

said second side surface defining a generally cylindrical depression in registration with said cylindrical projecting portion, said cylindrical depression terminating in a second generally circular planar wall, said second generally circular planar wall having a planar inner surface disposed in spaced relation with the first side surface of said display structure;

a coin receiving chamber defined by said first and second circular planar walls and said circumferential wall;

said first and second planar walls and said circumferential wall formed from optically transparent material;

whereby opposing sides of a coin received within said coin receiving chamber is visible through said first and second planar walls and the edge of said coin is visible through said circumferential wall; and an integral base, said base including a generally planer bottom surface, whereby said base functions to maintain said display structure in a free-standing manner on a substantially horizontal supporting surface.

2. A coin holder and display device according to claim 1, wherein said base comprises at least one horizontally projecting foot.

3. A coin holder and display device according to claim 1, wherein said base is detachable.

4. A coin holder and display device according to claim 1, wherein said display structure further includes an internal portion containing alpha-numeric indicia, and at least one optically transparent window for viewing said alpha-numeric indicia.

* * * * *